United States Patent [19]

Killop et al.

[11] Patent Number: 4,689,980

[45] Date of Patent: Sep. 1, 1987

[54] METHOD FOR SNAP RING FORMING AND GROOVING

[75] Inventors: James T. Killop, Warren; Gerald W. Holbrook, Saint Clair, both of Mich.

[73] Assignee: Anderson-Cook, Inc., Fraser, Mich.

[21] Appl. No.: 907,475

[22] Filed: Sep. 15, 1986

Related U.S. Application Data

[62] Division of Ser. No. 769,581, Aug. 25, 1985, Pat. No. 4,644,772.

[51] Int. Cl.[4] ..... B21D 17/04

[52] U.S. Cl. ..... 72/88; 72/108; 72/111; 72/469

[58] Field of Search ..... 72/68, 88, 90, 102, 72/105, 106, 108, 111, 469

[56] References Cited

U.S. PATENT DOCUMENTS

| | | | |
|---|---|---|---|
| 4,181,001 | 1/1980 | Zalesak et al. | 72/108 |
| 4,487,047 | 12/1984 | Killop | 72/469 |
| 4,574,605 | 3/1986 | Stein | 72/88 |

FOREIGN PATENT DOCUMENTS

| | | | |
|---|---|---|---|
| 52847 | 4/1977 | Japan | 72/88 |
| 11123 | 2/1981 | Japan | 72/90 |
| 71540 | 6/1981 | Japan | 72/90 |

*Primary Examiner*—Lowell A. Larson

*Attorney, Agent, or Firm*—Reising, Ethington, Barnard Perry & Milton

[57] ABSTRACT

A method for simultaneously forming splines and an annular groove in a metal piece having a central portion and ends on each side thereof, the method including the steps of forming a substantially U-shaped annular recess (56) along the central portion of the workpiece which has a flat base and spaced sidewalls which are spaced apart to a greater distance than the side walls of the groove (82) to be formed, deforming the recess (56) to initially form a groove (82) therein, progressively and simultaneously forming splines in the ends of the workpiece and forming the groove (82) in the recess of the workpiece, and moving metal outwardly and upwardly from the recess as the groove (82) is formed to fill the remainder of the recess (56) and form the sidewalls of the groove (82).

6 Claims, 12 Drawing Figures

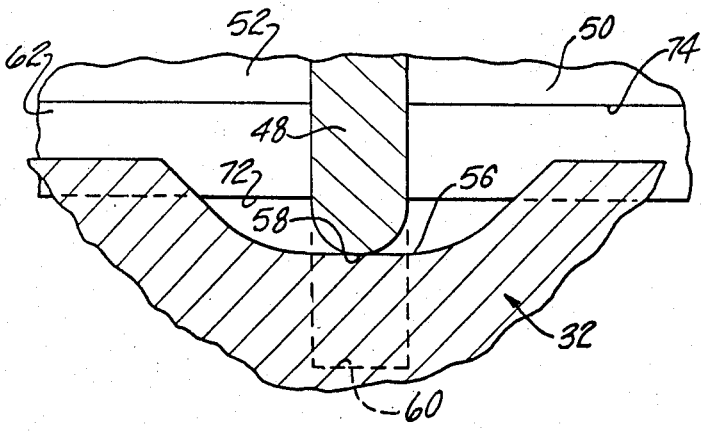
Fig-3
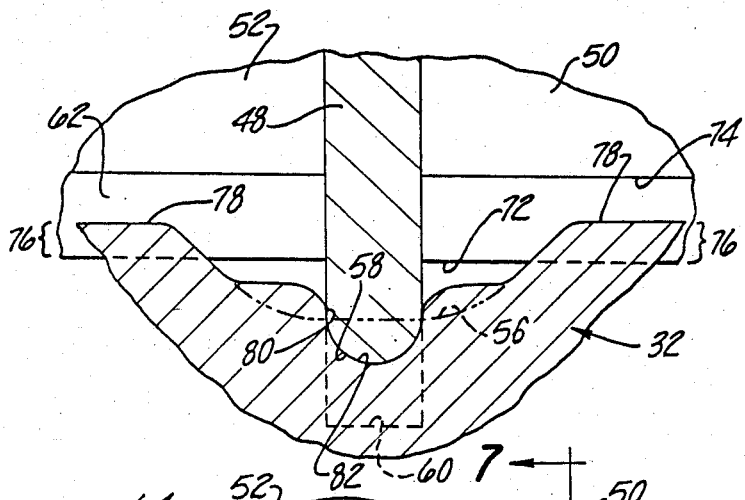
Fig-4
Fig-7
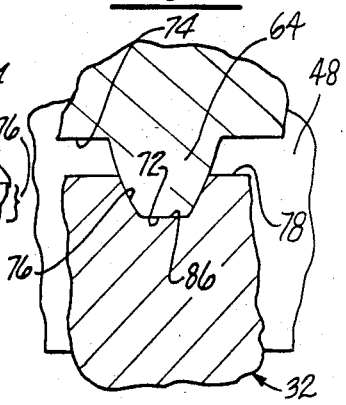
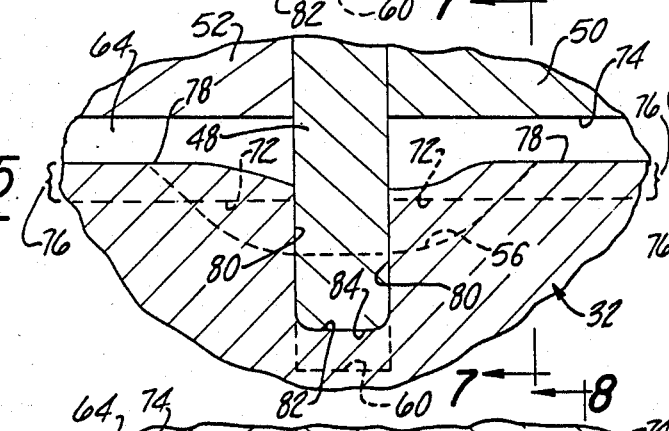
Fig-5
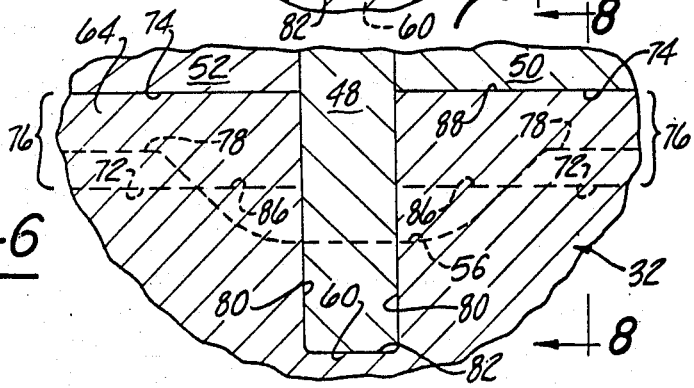
Fig-6
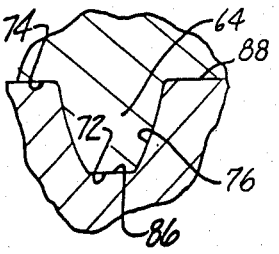
Fig-8

METHOD FOR SNAP RING FORMING AND GROOVING

This application is a divisional application of U.S. Ser. No. 769,581, filed Aug. 25, 1985, now U.S. Pat. No. 4,644,772, issued on Feb. 24, 1987.

TECHNICAL FIELD

The invention relates generally to a machine for forming splines and a snap ring groove in a cylindrical member.

BACKGROUND OF THE INVENTION

Mechanisms of the type for performing a splining operation on a workpiece generally include a pair of elongated dies slidably mounted with respect to each other and spaced in parallel relationship and movable between an end-to-end relationship and an overlapping relationship. Each of the dies include teeth spaced along the length thereof for forming splines. Problems have been encountered in forming snap ring grooves in cylindrically splined members and prior art methods have employed grinding or other techniques for forming the grooves, for example, cutting the grooves in after the splining operation which is expensive and not economical on a mass production scale.

U.S. Pat. No. 446,932 to Simonds shows a method and apparatus for making screw threaded rolled formings including a groove forming section and thread forming protrusion and U.S. Pat. No. 446,933, also to Simonds, discloses a device for knurling the surface of metal articles including a groove forming portion and a knurling forming portion. Another U.S. Pat. No. 446,934 to Simonds discloses a rolled forging making assembly for making non-circular members including spreading and reducing surfaces and forming surfaces. However, none of the above patents disclose a mechanism for forming grooves in a splined member during a single rolling operation.

STATEMENT OF INVENTION AND ADVANTAGES

The present invention is directed to a machine and method for forming a snap ring groove in a splined workpiece, as well as the resultant member produced thereby. The machine comprises mounting means rotatably supporting the workpiece for rotary movement, die means including opposed splineforming work surfaces spaced on opposite sides of the axis of the workpiece for forming splines therein, and is characterized by cutting means disposed in the work surfaces for grooving the workpiece as the work surfaces are moved relative to one another during the spline-forming operation.

The method comprises the steps of rotatably supporting the workpiece for rotary movement and movably supporting a plurality of die means having spaced spline-forming work surfaces for movement relative to one another on opposite sides of the axis of the workpiece. The method is characterized by the steps of retaining a cutting member in the spline-forming work surfaces and moving the die means relative to one another to engage the spline-forming work surfaces and the cutting member with the workpiece therebetween, simultaneously performing a grooving and splining operation on the workpiece.

The resultant product is a transmission member having a splined portion characterized by a transverse groove formed therein by the abovedescribed process incorporating die means having opposing spline-forming work surfaces spaced for relative movement on opposite sides of a workpiece and cutting means disposed in the work surfaces for simultaneously grooving the workpiece as the work surfaces are relatively moved to form splines therein.

An advantage of the subject invention is simultaneous cold forming of splines and a snap ring groove in a workpiece with a single pass of cold-forming dies.

Another advantage of the subject invention is that a shaft can be fabricated having a snap ring groove formed in the splined portion with a minimal amount of burrs at the junction between the snap ring groove and spline.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is an enlarged fragmentary cross-sectional view of the invention prior to commencement of the groove-forming operation on the workpiece;

FIG. 4 is an enlarged fragmentary cross-sectional view of the invention showing the member being splined following commencement of the groove-forming operation;

FIG. 5 is an enlarged fragmentary cross-sectional view of the invention showing the workpiece being splined as the groove is further being formed in the workpiece;

FIG. 6 is an enlarged fragmentary cross-sectional view of the invention showing the final stage of the groove forming in the workpiece;

FIG. 7 is a cross-sectional view of the invention taken substantially along the lines 7—7 of FIG. 5 showing a portion of the member being splined by one of the leading die teeth;

FIG. 8 is a cross-sectional view of the invention taken substantially along the lines 8—8 of FIG. 6 showing a workpiece being splined by a larger one of the die teeth near the trailing edge of one of the dies;

DETAILED DESCRIPTION OF THE PREFERRED EMBODIMENTS

Figure 1:
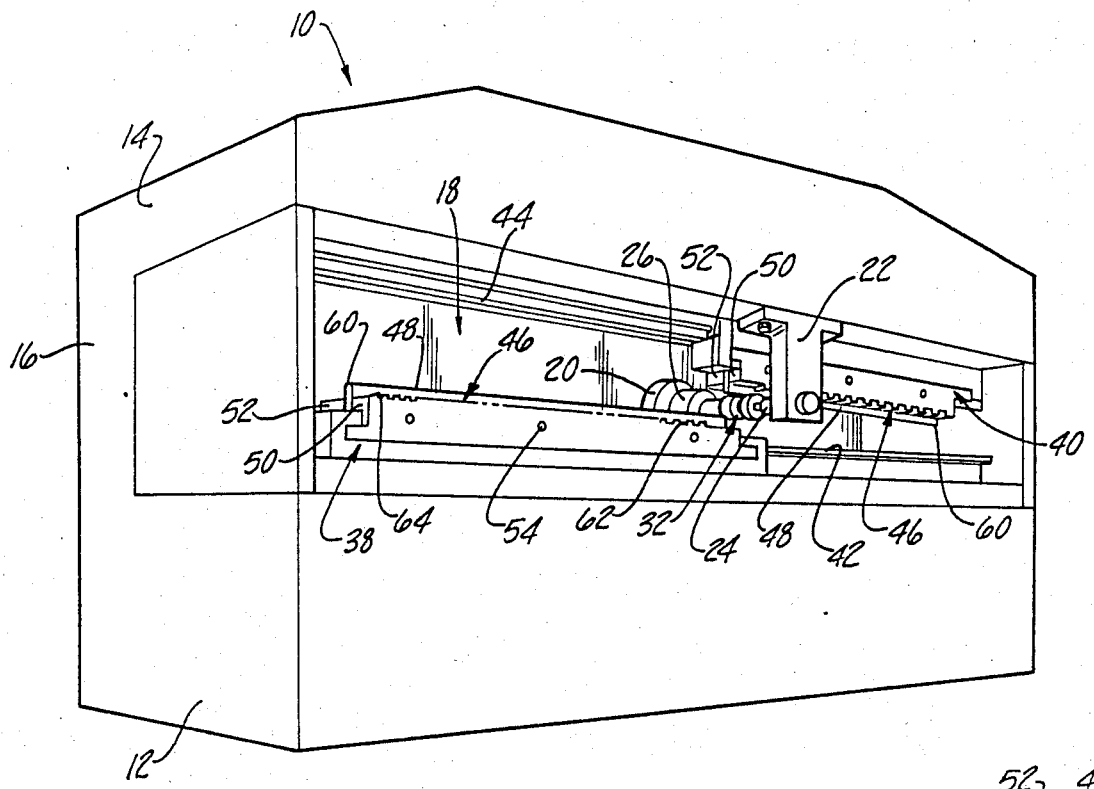
FIG. 1 is a perspective view showing a machine of the subject invention.

In FIG. 1 a spline-forming machine adapted to form grooves in a workpiece is generally shown at 10. The machine 10 includes a lower support base 12, an upper base 14, and a support portion 16. The support portion 16 extends upwardly from the lower base 12 and the upper base 14 extends forwardly from the support portion 16 to cooperate with the lower base in defining a downwardly Within the work space 18, a fixed head stock 20 is mounted on the support portion 16 between the lower and upper bases 12 and 14. A tail stock support arm 22 projects downwardly from the upper base 14 and includes a suitable slide arrangement for supporting a tail stock or shaft 24 which is slidably movable toward and away from the head stock 20 along a rectilinear path. The head stock 20 includes a chuck member 26 having jaws 28 (shown diagrammatically in FIGS. 2 and 11) for retaining an end 30 of the workpiece, generally indicated at 32, therein. The tail stock shaft 24 has a pointed end 34 for centering the axis of the shaft 24 in a corresponding recess 36 in the end of the workpiece 32 opposite the end 30 thereof held in the chuck member 26. The chuck member 26 and tail stock shaft 24, including the pointed end 34 received within the central recess 36 of an end of the workpiece 32, all comprise mounting means rotatably supporting the workpiece for rotary movement. A pair of die means, shown in FIG. 1 as lower and upper die members, respectively, are generally indicated at 38 and 40. The lower die member 38, shown in FIG. 1 as an elongated rack, is slidably supported on the lower base 12 by a slide support 42. The upper die member 40 is also shown as an elongated rack slidably supported on the upper base 14 by another slide support 44. The slide supports 42 and 44 mount the dies 38 and 40 in a parallel spaced relationship with respect to each other for sliding movement between an end-to-end relationship shown in FIG. 1 and indicated by the arrows, and an overlapping relationship. Each of the dies 38 and 40 is elongated rectilinearly and has a spline-forming work surface comprising a series of teeth, generally indicated at 46, spaced along the length thereof. The die teeth 46 on each work surface extend transversely with respect to the direction of die movement and are oriented in a spaced and parallel fashion opposing the die teeth of the other of said die members when the dies assume their overlapping relationship after movement in the direction of the arrows 48 as shown in FIG. 1. The dies are actuated by a suitable power-operated actuator that coordinates the movement of each die with that of the other to perform the splining operation of the subject invention. Suitable deflection control means are associated with the respective bases to control the deflection permitted between the dies as the splining operation proceeds. According to the invention, there is provided cutting means, in the form of a blade member 48, disposed in each of said work surfaces 46 for grooving the workpiece 32 as said work surfaces 46 are moved relative to one another during the spline-forming operation.

Figure 2:
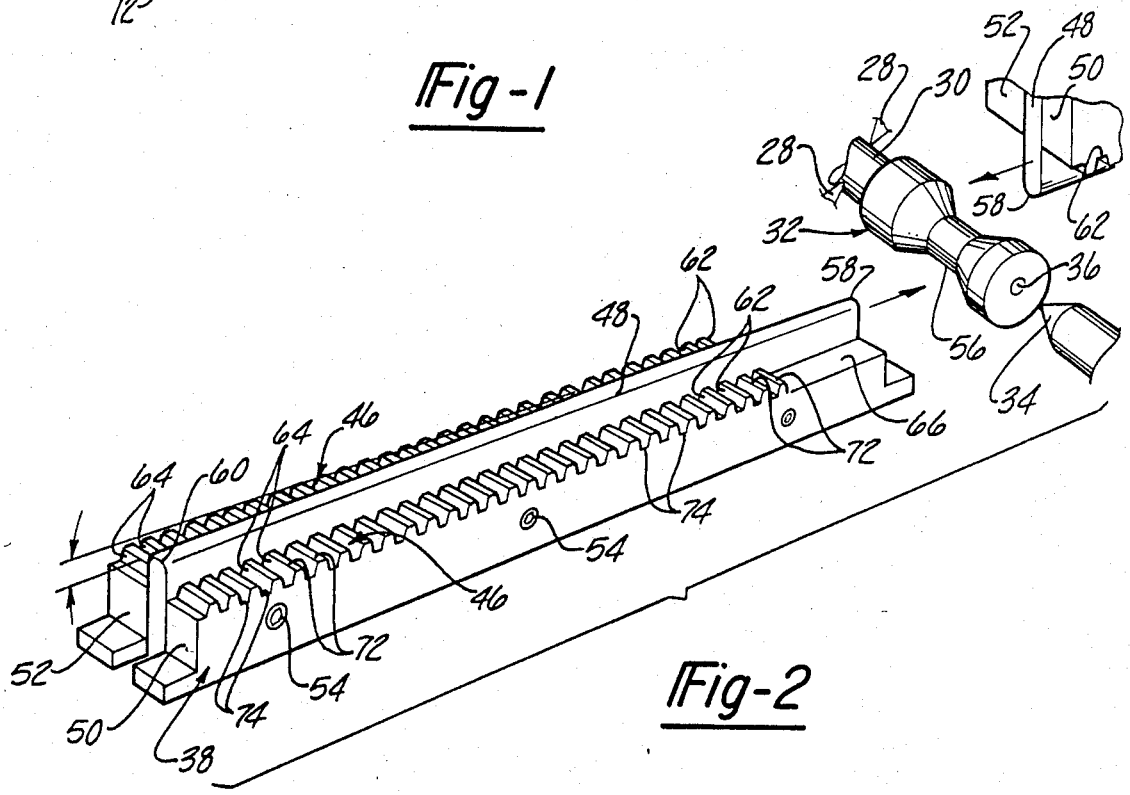
FIG. 2 is a perspective view of the invention prior to commencement of the forming operation.

As shown more clearly in FIG. 2, the die member 38 comprises separate elongated body portions 50,52 having dual upper work surfaces 46 secured together by bolts 54 and separated by the cutting member 48 being sandwiched therebetween, forming a unitary composite structure.

The mounting means hereinbefore described rotatably supports a generally cylindrical workpiece 32 between the opposed work surfaces 46 which are shown in FIG. 2 prior to the commencement of the respective forming operations. According to the invention, the workpiece 32 is preformed with a recess 56 adapted to cooperate with the blade member 48, resulting in a vertically walled snap ring groove described below in conjunction with FIGS. 3 through 6. Each blade member 48 is identical in configuration and has opposed leading 58 and trailing 60 edges respectively situated adjacent leading 62 and trailing 64 end teeth of said work surfaces 46. The blade member 48 has a rounded exposed edge at the leading edge 58 thereof and tapers along the length of the blade member to a squared cross section at the trailing edge 60. Alternatively, the blade member 48 may have a pointed exposed leading edge 58 tapering to a rectangular cross section at said trailing edge 60. Each blade member 48 preferably has a progressively increasing height (at an angle indicated by the arrows in FIG. 2) from the leading to the trailing edge thereof so that continued opposed movement of the die members 38,40 progressively cuts a deeper groove into the recess 56 of the workpiece 32. The work surfaces 46 on the respective body portions 50,52 of the dies 38,40 are grooved together with teeth on one of said work surfaces 46 forming a continuation or extension of teeth on the other of said work surfaces, that is, valleys between the die teeth on one side of the blade member 48 are precisely continuous with corresponding valleys on the other side of said blade member 48 for synchronous forming by the dual work surfaces. Preferably, each of the body portions 50,52 have corresponding nontoothed surfaces 66 situated on either side of the blade member adjacent the leading edge 58 thereof, allowing initial grooving of the workpiece 32 at the leading edge prior to commencement of a simultaneous splining operation.

Figure 10:
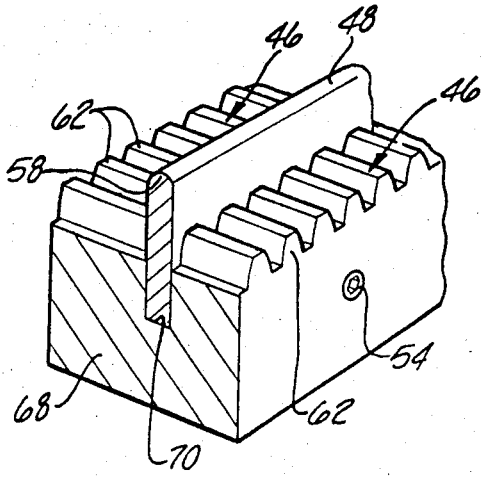
FIG. 10 is an enlarged fragmentary view of the invention showing an alternative construction of one of the dies.

FIG. 10 shows an alternative construction of a portion of a die member having a solid one-piece body portion 68 formed with an elongated slot 70 extending transversely to the work surfaces 46 for receiving and retaining the blade member 48 therein. It is also possible to construct a die member wherein a groove-forming blade extends discontinuously from a leading to a trailing end of the toothed work surface, forming grooves in the workpiece only adjacent the leading and trailing edges of the blade member without the necessity for an intermediate forming portion of the blade.

As shown in FIGS. 7 and 8, the teeth on the spline-forming surfaces 46 of the dies have progressively increasing heights from the leading end 62 to the trailing end 64 thereof to progressively form splines in the workpiece as the dies members 38,40 are moved from an end-to-end relationship to an overlapping relationship. Thus, both the splines and grooves are progressively formed as illustrated in FIGS. 3 through 8.

In FIG. 3, the rounded leading edge 58 of the blade member is shown prior to contact with the bottom of the recess 50 (shown for reference purposes as a phantom line 50 in FIGS. 4 through 8). The squared trailing edge 60 of the blade 48 is shown by phantom lines 60 in FIGS. 3 through 5.

FIG. 3 shows the exposed leading edge 58 of the blade member 48 extending outwardly from the leading end 62 (FIGS. 1, 2 and 10) in the direction of movement of its associated die member, prior to contact with the recess 50 in the workpiece 32. The level of the untoothed surface 66 preceding the leading teeth 74 of the work surface 46 (FIG. 2) represents the root 74 of the teeth on spline-forming surfaces 46.

The method for performing a spline-forming operation on the workpiece 32 comprises the steps of rotatably supporting the workpiece 32 for rotary movement utilizing the aforesaid mounting means; movably supporting the die members 38,40 having spaced splineforming work surfaces 46 for movement relative to one another on opposite sides of the axis of the workpiece 32 and retaining the cutting member 48 therein. FIG. 4 illustrates the subsequent step of moving the die members relative to one another to engage initially the leading teeth 62 on the respective spline-forming surfaces 46 and said cutting members 48 with the workpiece 32 therebetween. The crest 72 of one of the leading teeth 62 is shown in FIG. 4 forming a spline 76 in the outer wall 78 of the workpiece 32. As the leading edge 58 of the cutting member 48 begins to deform the bottom of the recess 50, the metal is moved outwardly and upwardly to fill the recess 50 while defining side walls 80 of a snap ring groove 82.

In FIG. 5, the die members have been further moved relative to one another to engage an intermediate tapered portion 84 of the blade member 48 to further deform the groove 82, causing migration of more material into the recess 50 to further define vertical side walls 80 of the groove 82. The intermediate edge 84 of the blade 48 is rectangular with rounded corners to progressively form the bottom of the snap ring groove 82 into a squared configuration. The dotted reference line 50 indicates the original position of the recess in the area of material which is caused to migrate during the forming of the groove 82.

In FIG. 6, the die members have been moved from an end-to-end relationship all the way to an overlapping relationship to engage teeth on the respective trailing edges of the dies and the squared trailing edge 60 of the blade member 48 with the workpiece 32 therebetween to finish forming the groove 82 therein.

FIG. 6 depicts the completed grooving operation following movement of the dies from their end-to-end relationship to their overlapping relationship. The trailing edge 60 of the blade member 48 is shown by solid lines in the position shown in phantom in FIGS. 3 through 5.

FIG. 7 illustrates the progressive splineforming operation by teeth having progressively increasing heights from the leading 62 to the trailing 64 ends of the respective work surfaces 46. The representative tooth shown in FIG. 7 is situated adjacent the intermediate tapered edge of the blade member and the root 74 thereof is spaced from the outer surface 78 of the workpiece.

As the groove 82 is being formed and material of the preformed recess 56 moved to fill the recess 56, the original outer surface 78 of the workpiece, shown in solid lines in FIGS. 3 through 5, is deformed by the die teeth 62,64 during the simultaneous spline-forming operation. The die teeth 62,64 deform the outer surface 78 of the workpiece, forming splines 76 each having a root 86 (FIGS. 7, 8 and 9) and a crest represented by the outer splined surface 78 of the workpiece. The outer surface 78 is deformed so that metal is displaced above and below the original unsplined surface 78 of the workpiece, respectively forming the crest 88 and the root 86 of each of the splines 76. This displacement of metal is combined with the displacement occurring vis-a-vis the simultaneous grooving operation taking place during the splining operation, particularly, filling of the original preformed groove 50 (solid lines in FIG. 3) by the material displaced by the cutting blade 48, causing a further build-up of the outer surface of the workpiece.

FIG. 6 illustrates the actual displacement of the original outer surface 78 (shown in phantom) of the workpiece so that the crest 88 of each spline 76 abuts the root 74 of each die tooth 64 and the root 86 of each spline is contiguous with the crest 72 of the die tooth 64 during the spline-forming operation. In further reference to FIG. 6, the area bounded by phantom line 78 (original outer surface of the workpiece) and the crest 88 of the spline 76 (shown in brackets) represents the material which has been displaced upwardly from the original outer surface 78 (phantom) of the workpiece. Similarly, the area bounded by the root 86 (shown in phantom) and the original outer surface 78 (shown in phantom) represents the valley displaced to form the splines 76 in the workpiece. It will be further noted that additional material is displaced by the blade member 48, as described above, completely fills in the recess and rises around the blade member 48 during the forming operations until it is contiguous with the completely formed splines as shown in FIG. 6.

Figure 9:
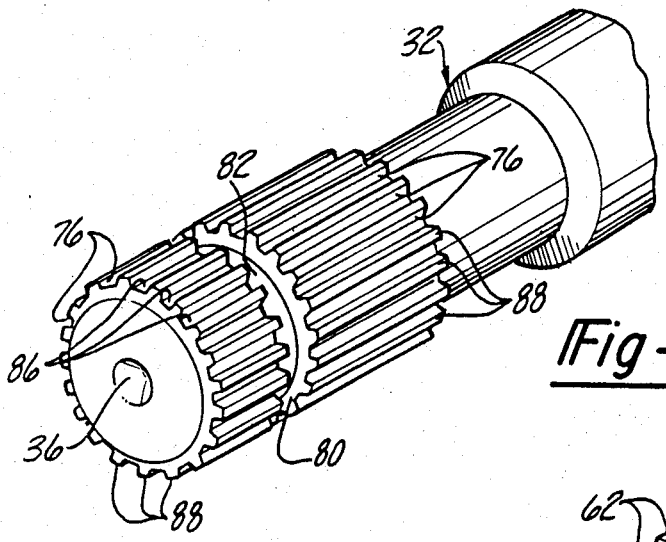
FIG. 9 is a perspective view of the invention showing the resultant splined member having a groove formed therein.

In summary, a member resulting from the above-described operations performed on a workpiece 32, as depicted in FIG. 9, has a splined portion including splines 76 and a circumferentially extending groove 82 formed in said splined portion by a process incorporating the above plurality of die members having opposing spline-forming work surfaces 46 spaced for relative movement on opposite sides of the workpiece 32 and a cutting member 48 disposed in said work surfaces 46 for simultaneously grooving the workpiece 32 as said work surfaces 46 are relatively moved to form splines 76 in the workpiece 32. The preformed recess 50 in the workpiece 32 is deformed into a finished groove 82 having vertical side walls 80 by successively engaging rounded leading edges 58 of opposed cutting members 48 with said workpiece 32 and thence an intermediate tapering to a squared trailing edge 60 to progressively form a snap ring groove 80 having a generally flat bottom to receive the circumferential edge of a cup-shaped member or the like.

Figure 11:
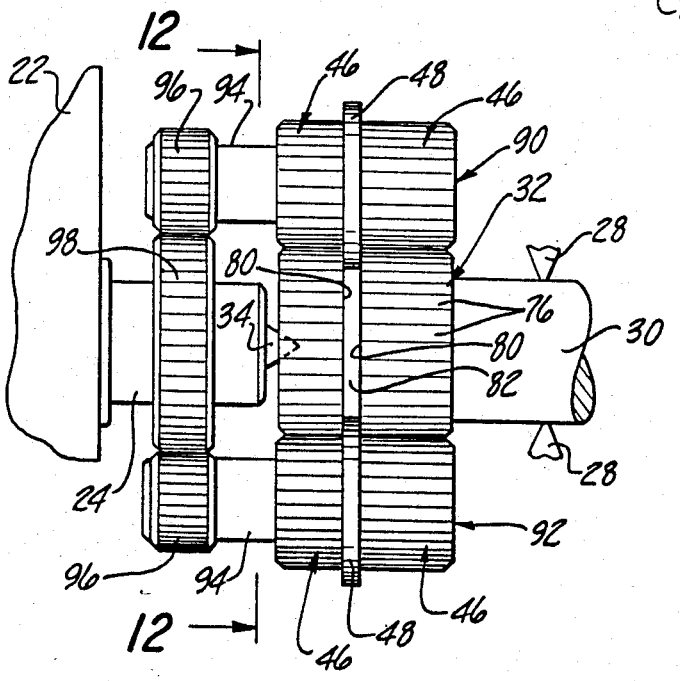
FIG. 11 is a perspective view of the invention showing a workpiece being grooved by opposed rotary dies during a spline-forming operation.
Figure 12:
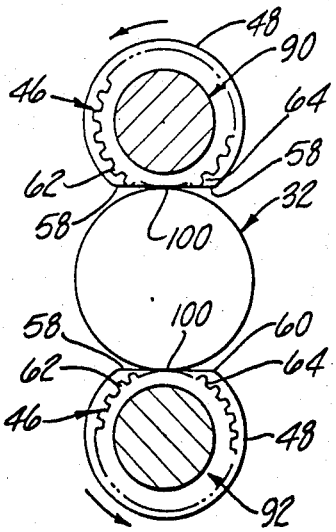
FIG. 12 is a cross-sectional view of the invention taken substantially along the lines 12—12 of FIG. 11.

An alternative die configuration is shown in FIGS. 11 and 12, wherein a pair of rotary die means, generally indicated at 90 and 92, respectively, comprise opposed curvilinear toothed work surfaces 46 mounted for relative rotary movement. An end 30 of the workpiece 32 is rotatably supported within the jaws 28 of a chuck member (not shown) similar to the manner described above and a tail stock supported on a support arm 22 for movement toward and away from the chuck member has a centering point 34 adapted to be received within the recess 36 at the opposite end of the workpiece 32. The die members 90,92 are shown without their associated support structures which are constructed in accordance with a manner well-known in the art. Each of the dies 90,92 typically has an unsplined shaft portion 94 extending toward the tail stock support arm 22 and having a row of circumferentially extending teeth 96 engaging a similar row of circumferentially extending teeth 98 on said tail stock 24. The die members are rotated by a suitable drive means (not shown) so that opposing pairs of teeth 96,98 on the shaft member 94 and tail stock 24, respectively, are engaged to drive the dies during the forming operations. Either of the dies 90 or 92 can be the driven die.

FIG. 12 diagrammatically shows the arrangement of teeth on the dual work surfaces 46 of the dies 90,92 with the teeth circumferentially extending about the rotary dies 90,92 from a leading edge 62 to a trailing edge 64, whereby the dies are rotated to engage opposing teeth on the leading end 62 of the respective work surfaces of the dies along with the leading edges 58 of the cutting member 48 during commencement of the forming operations. The upper die 90 is rotated counterclockwise and the lower die 92 rotated counterclockwise (arrows) forming splines and a groove as the workpiece rotates, until the dies are ultimately rotated to engage teeth on the trailing end 64 of the work surfaces 46 and the trailing edge 60 of the blade members 48, completely forming splines 76 and a groove 82 in the workpiece 32. The dies are then returned to the initial position. To facilitate loading and unloading of the workpiece from between the dies, notch portions 100 are provided in each die and aligned together in the loading position to accommodate loading of the workpiece between the dies and unloading of the workpiece following the operation.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method for simultaneously forming splines and an annular groove in a metal workpiece having central portions and ends on each side thereof, said method including the steps of: forming a substantially U-shaped annular recess (56) along the central portion of the workpiece which has a flat base and spaced side walls which are spaced apart to a greater distance than the side walls of the groove (82) to be formed; deforming the recess (56) to initially form a groove (82) therein; progressively and simultaneously forming splines in the ends of the workpiece and forming the groove (82) in the recess of the workpiece and moving metal outwardly and upwardly from the recess as the groove (82) is formed to fill the remainder of the recess (56) and form the side walls of the groove (82).

2. A method as set forth in claim 1 wherein said step of forming the recess (56) is further defined as outwardly angling the side walls of the recess (56).

3. A method as set forth in claim 31 further characterized by the steps of deforming the recess (56) by engaging a leading edge (58) of an elongated blade member (48) with said recess (56) and forming the groove (82) therein prior to engaging opposed teeth at respective leading ends (62) of spline-forming work surfaces (46) with the outer surface of workpiece (32); subsequently engaging a trailing edge (60) of the blade member (48) with said recess (56) after a trailing end (64) of said spline-forming surface (46) has disengaged the workpiece (32).

4. A method as set forth in claim 3 further characterized by:

continuously performing a grooving operation on the workpiece while said work surfaces (46) are being relatively moved on opposite sides thereof.

5. A method as set forth in claim 3 further characterized by the steps of:

preforming a recess (56) in said workpiece (32);

relatively moving said blade members (48) to engage the bottom of said recess (56), causing material in said recess (56) to migrate forming a vertically walled (80) groove (82).

6. A method as set forth in claim 3 further characterized by successively engaging rounded leading edges (58) of opposed blade member (48) with said recess, then intermediate tapering edges and finally a tapering to a squared trailing edge (6) thereof, progressively forming the groove (82) in said recess (56).

* * * * *

UNITED STATES PATENT AND TRADEMARK OFFICE

CERTIFICATE OF CORRECTION

PATENT NO. : 4,689,980

DATED : September 1, 1987

INVENTOR(S) : James T. Killop; Gerald W. Holbrook

It is certified that error appears in the above-identified patent and that said Letters Patent is hereby corrected as shown below:

Column 1, line 50, delete "splineforming" and insert therefor --spline-forming--.

Column 2, line 3, delete "abovedescribed" and insert therefor --above-described--.

Column 3, line 4, after "downwardly" insert --confined work space, generally indicated at 18.--.

Column 8, line 35, delete "(6)" and insert therefor --(60)--.

Signed and Sealed this

Ninth Day of May, 1989

*Attest:*

DONALD J. QUIGG

*Attesting Officer*

*Commissioner of Patents and Trademarks*